US005102727A

United States Patent [19]

Pittman et al.

[11] Patent Number: 5,102,727

[45] Date of Patent: Apr. 7, 1992

[54] ELECTRICALLY CONDUCTIVE TEXTILE FABRIC HAVING CONDUCTIVITY GRADIENT

[75] Inventors: Edgar H. Pittman; Hans H. Kuhn, both of Spartanburg, S.C.

[73] Assignee: Milliken Research Corporation, Spartanburg, S.C.

[21] Appl. No.: 716,003

[22] Filed: Jun. 17, 1991

[51] Int. Cl.[5] ..... B32B 7/00

[52] U.S. Cl. ..... 428/259; 428/253; 428/257; 428/258; 428/408; 428/902

[58] Field of Search ..... 428/257, 258, 259, 253, 428/408, 902

[56] References Cited

U.S. PATENT DOCUMENTS 4,388,365 6/1983 Hasegawa ..... 428/259
4,606,968 8/1986 Thornton et al. ..... 428/257
4,746,541 5/1988 Marikar et al. ..... 427/126.1
4,803,096 2/1989 Kun et al. ..... 427/121
4,856,299 8/1978 Bryant ..... 66/202
4,929,803 5/1990 Yoshida et al. ..... 174/117 M
4,981,718 1/1991 Kuhn et al. ..... 427/121

*Primary Examiner*—James J. Bell
*Attorney, Agent, or Firm*—Timothy J. Monahan; H. William Petry

[57] ABSTRACT

An electrically conductive textile fabric is provided having a conductivity gradient created by varying the relative concentration of high and low conductivity yarns during construction of the fabric. In the case of woven and knitted fabrics, the relative number of high and low conductivity yarns per inch may be varied in the warp or weft direction or both.

12 Claims, 6 Drawing Sheets

FIG. —1—

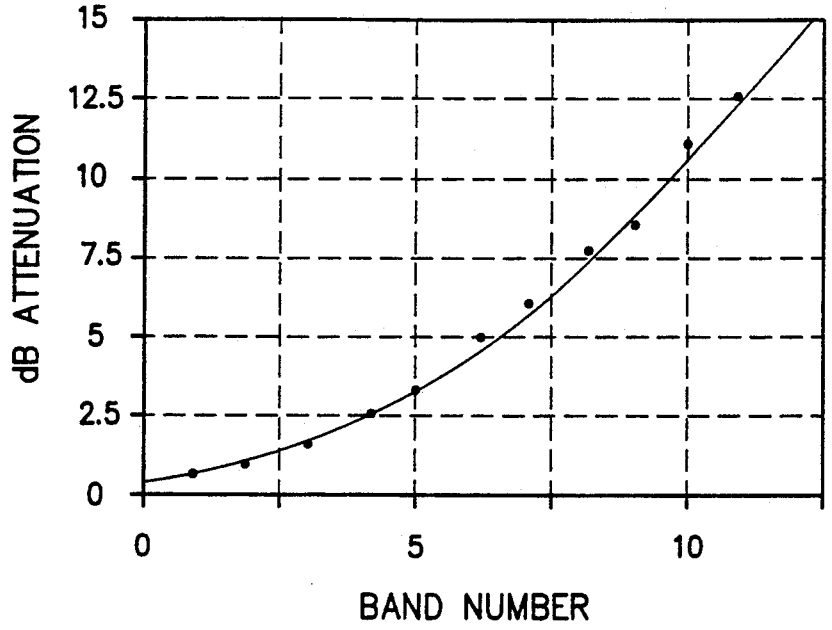
*FIG. —7—*
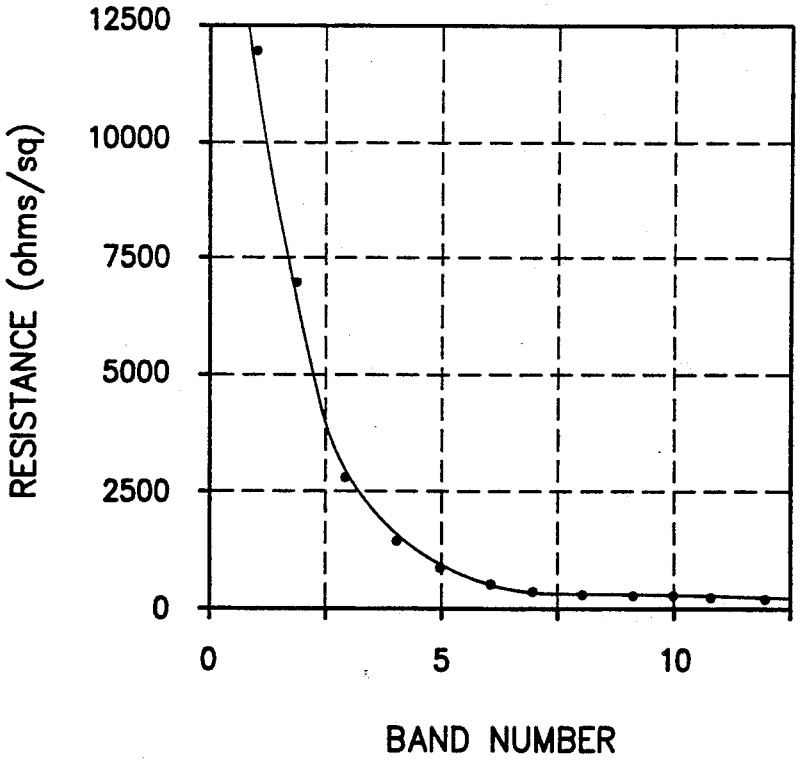
*FIG. —8—*

ELECTRICALLY CONDUCTIVE TEXTILE FABRIC HAVING CONDUCTIVITY GRADIENT

BACKGROUND OF THE INVENTION

1. Field of the Invention

This invention relates to a textile fabric constructed from electrically conductive yarns, and in particular to a fabric from yarns varying in conductivity which are arranged in the fabric to create a conductivity gradient therein.

2. Prior Art

Textile fabrics constructed from electrically conductive fibers are well known in the art. Mariker et al., U.S. Pat. No. 4,746,541, disclose electrically conductive, acrylic fibrous material which may be in the form of staple yarns, continuous filaments or a fabric. The invention of Mariker et al. may be useful for electromagnetic interference shielding and electrostatic discharge.

Electrically conductive materials made from a conductive polymer coated textile are described in Kuhn et al., U.S. Pat. No. 4,803,096. The textile material, such as a fiber, yarn or fabric, are placed in an aqueous solution of an oxidatively polymerizable compound and an oxidizing agent, resulting in a conductive polymer being formed on the surface of the textile material. The resulting polypyrole or polyaniline covered textile material has a resistivity in the range of 50 to about 10,000,000 ohms per square.

Textile fabrics having a distribution of both conductive and non-conductive fibers throughout are disclosed in Bryant, U.S. Pat. No. 4,856,299 and Yoshida et al., U.S. Pat. No. 4,929,803. In Bryant, a conductive fiber is knitted into a fabric, such as a towel, to impart improved static charge dissipation properties to the fabric. The conductive fiber is incorporated in the fabric in both the course and wale directions to dissipate an electrical charge in any direction. Yoshida et al. provide a woven fabric in which the conductive fibers are arranged in one direction only, for example in the weft direction only. In an alternate embodiment, the conductive fibers are alternated with non-conductive fibers which act to insulate individual conductive fibers from each other. The fabric is described as having anisotropic properties since current can only be conducted in one direction of the woven lattice, the direction in which the conductive fibers run.

One of the uses of electrically conductive fabrics is as a radar absorbing material (RAM) incorporated into the body of a military aircraft or other vehicle. Additionally, in the aforementioned applications, it is desirable to minimize the radar profile of the aircraft or vehicle to avoid detection and identification. It has been proposed to provide a fabric having a conductivity gradient, thereby allowing for a smooth transition around sharp edged surfaces, changes in surface angles or changes in surface composition. Material having a conductivity gradient may also be useful to give a smooth transition around radar equipment. Methods of treating a textile material, rendered electrically conductive by a coating of a conductive polymer, to produce a gradient are disclosed in Adams, Jr. et al., pending U.S. patent application Ser. No. 07/448,035, filed Dec. 8, 1989 and Gregory et al., pending U.S. pat. application Ser. No. 07/589,125. The applications relate to water jet etching and chemical reduction of the conductive polymer coating respectively, to achieve a gradient in the previously uniformly conductive textile fabric. A drawback of foregoing inventions is that subsequent to manufacturing a textile fabric from conductive polymer coated fibers, the fabric must undergo an additional processing step, namely etching or chemical reduction to create the gradient.

SUMMARY OF THE INVENTION

Therefore, an object of the present invention is to provide an electrically conductive fabric having a conductivity gradient. Another object of the invention is to provide a fabric incorporating a conductivity gradient while avoiding processing steps subsequent to the fabric having been woven or knitted.

Accordingly, an electrically conductive textile fabric is provided having a conductivity gradient therein created by selective arrangement of yarns of varying conductivity, preferably by weaving or knitting. The gradient is created by concentrating relatively high conductivity yarns in a first area of the fabric and concentrating relatively low conductivity yarns in a second area of the fabric. The high and low conductivity yarns constitute the body of the fabric, as for example, the weft of a woven or knitted fabric. For most applications it is desirable to have a smooth transition between the first and second areas. For example, by gradually balancing the concentration of the low conductivity yarns and the high conductivity yarns one can provide a linear or quadratic transition between the area of highest conductivity and the area of least conductivity. The term yarn is used throughout to encompass one or more filaments, including metal wires, individual staple fibers or a bundle of staple fibers.

A wide variety of filament, fiber and yarn types and constructions may be advantageously employed in the fabric as the high and low conductive yarns. By way of example, yarn characteristics which can be varied to distinguish high and low conductivity yarns include the number of conductive filaments in a yarn relative to the number of non-conductive filaments where the total number of filaments or denier is constant, the number of conductive filaments in the yarn where the total number of filaments or denier is decreased to decrease conductivity, choice of conductive yarn, and in the case of yarns which have been coated to render them conductive, the degree of conductivity imparted by varying the coating thickness and coherence.

An advantage of the invention is that the conductivity of the yarns may be measured prior to construction of the fabric, resulting in stricter control and better reproducibility of the gradient contained therein.

BRIEF DESCRIPTION OF THE DRAWINGS

FIG. 7 is a graph of the fabric of Example 2 plotting decibels of attenuation along the length of the fabric.

FIG. 8 is a graph of the fabric of Example 2 plotting resistance along the length of the fabric.

DESCRIPTION OF THE PREFERRED EMBODIMENT OF THE INVENTION

Without limiting the scope of the invention, the preferred features of the invention are hereinafter set forth.

The term textile fabric is intended to include woven, knitted and non-woven fabrics, preferably those woven or knitted. The fabrics may be constructed from a combination of yarns, including a high conductivity yarn having an electrical resistance of less than 10,000,000 ohm per inch. Examples of suitable high conductivity yarns include those containing metallic filaments selected from copper, aluminum, silver, nickel, iron, steel and cobalt, carbon fibers and filaments, relatively non-conductive fibers rendered conductive by deposition of a conductive material thereon, such as polypyrole, polyaniline or other conductive polymer as described in Kuhn et al., U.S. Pat. No. 4,803,096, hereby incorporated by reference, or by deposition of silver or copper sulfide as is well known in the art. The high conductivity yarns may also be constructed from a conductive filament or spun fiber which is plied into a yarn with a another, less conductive filament or spun fiber. One can readily see that the conductivity of a yarn can be readily varied by, for example, incorporating a greater or lesser number of conductive filaments relative to the number of non-conductive or low conductivity filaments. Alternatively, the conductive and non-conductive filaments or spun fibers are not twisted together to form a plied yarn, but are arranged in parallel and woven or knitted into the fabric as a single yarn.

Figure 1:
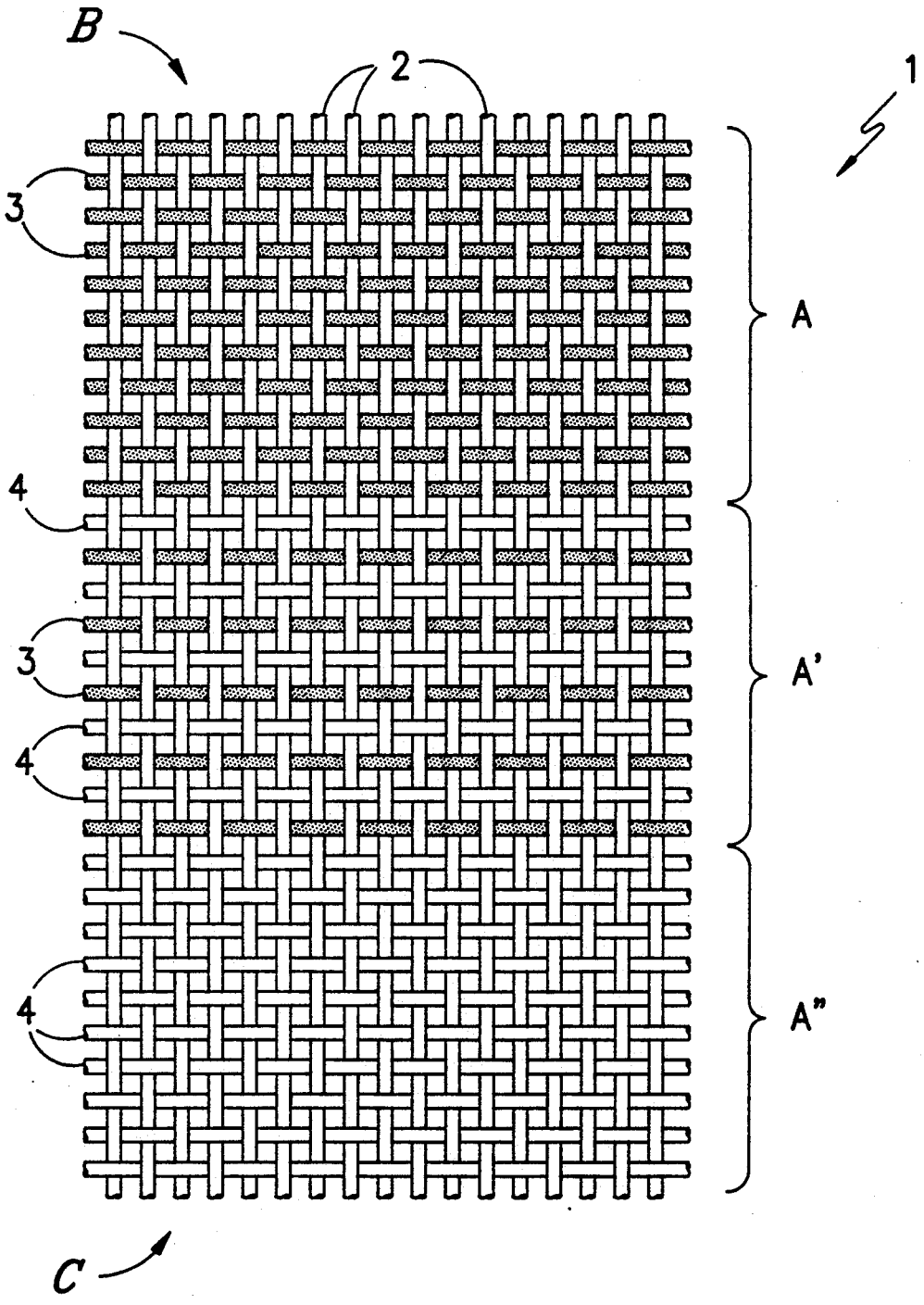
FIG. 1 is a woven fabric having a gradient created by a pattern of weft yarns.

A gradient is created in the fabric between an area having a relatively high conductivity and an area having relatively low conductivity by selective incorporation of high and low conductivity yarns into the fabric. Referring to FIG. 1, woven fabric 1 having non-conductive warp yarn 2 and weft or filling yarns 3 and 4. Weft yarns 3 are high conductivity yarns. Weft yarns 4 are relatively less conductive and are referred to throughout as low conductivity yarns. The low conductivity yarns have a conductivity which is relatively lower than the high conductivity yarns and may be essentially non-conductive, defined herein as yarns having a resistance of greater than 10 million ohms per inch. In FIG. 1, weft yarns 3 and 4 are arranged in groups of ten designated as bands A, A' and A". As one moves from the top B of fabric 1 to the bottom C, the relative number of high conductivity yarns in each band decreases while the number of low conductivity yarns increases. For example, band A contains ten high conductivity yarns and no low conductivity yarns. Band A' represents a transition area between the area of highest and lowest conductivity and contains five high conductivity yarns and five low conductivity yarns. At the bottom C of fabric 1, band A" has no high conductivity yarns and ten low conductivity yarns. The concentration or the location of the yarns are varied to produce areas of high and low conductivity. One can readily appreciate that the conductivity in the area of band A is much greater that of band A" and that this difference in conductivity represents a gradient in the fabric.

Figure 2:
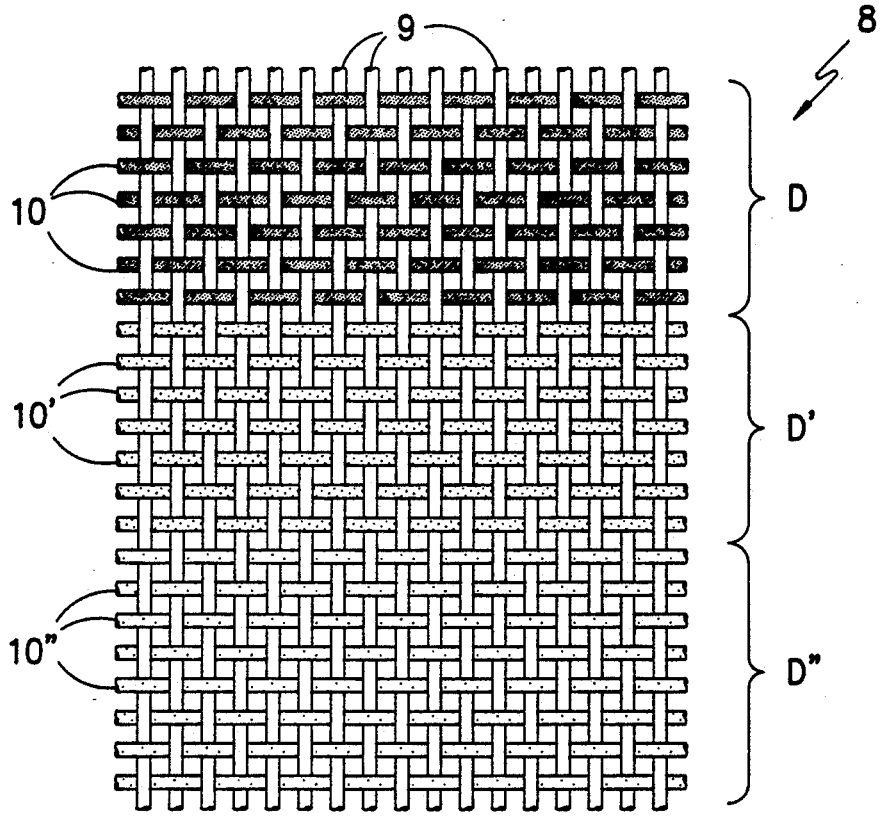
FIG. 2 is a woven fabric having a gradient created by varying the conductive filaments in the weft yarns.
Figure 3:
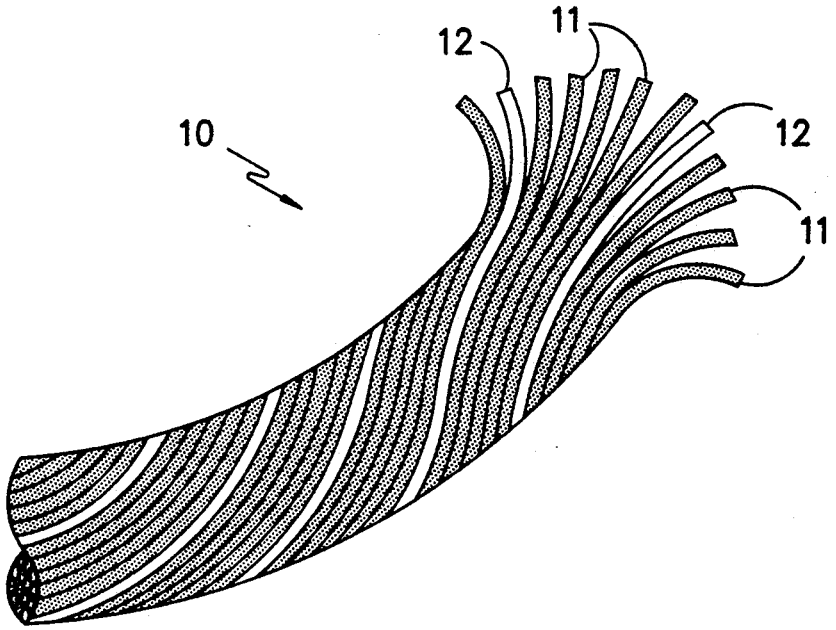
FIG. 3 is a multifilament yarn having both conductive and non-conductive filaments.
Figure 4:
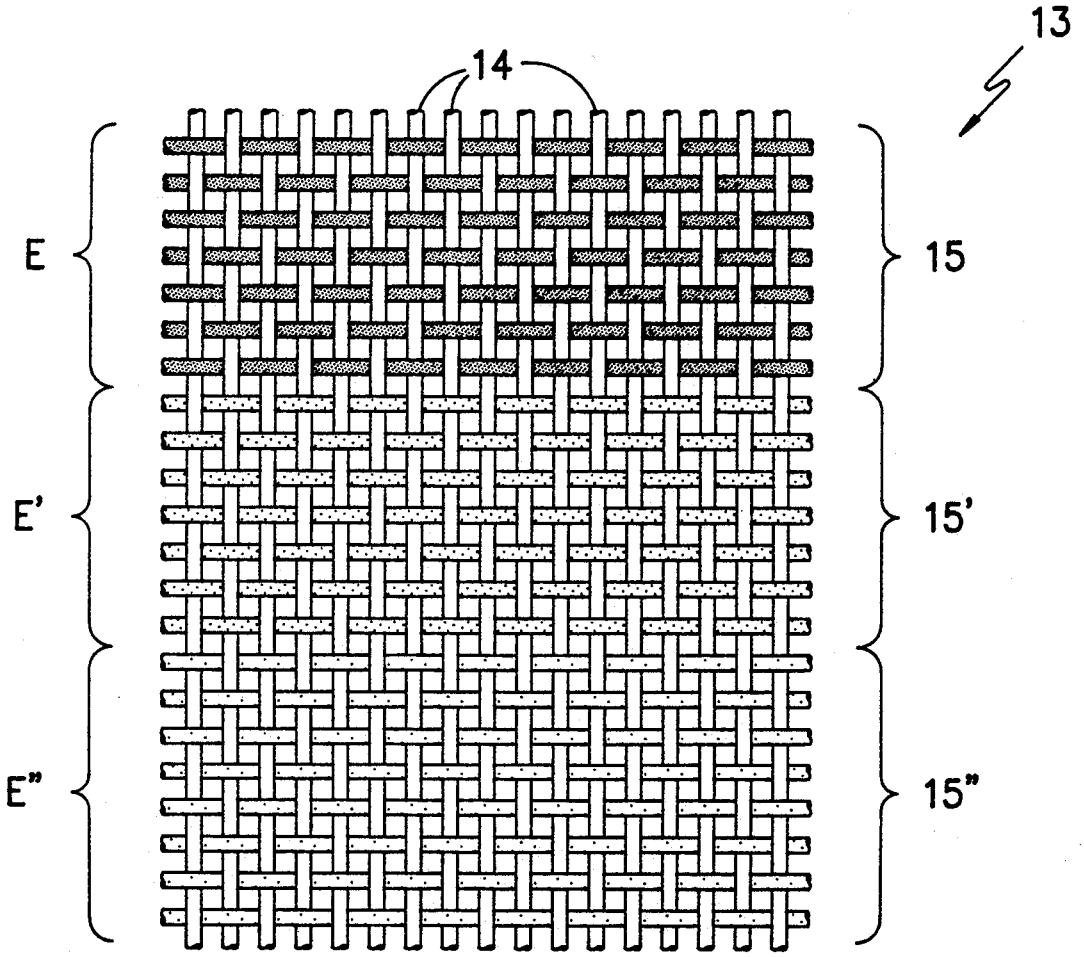
FIG. 4 is a woven fabric having a gradient created by bands of weft yarns which vary in conductivity.

Alternate schemes to produce a gradient in a woven fabric are disclosed in FIGS. 2-4. In FIG. 2, fabric 8 has nonconductive warp yarns 9 and, for filling, weft yarns 10, 10' and 10". Referring to FIG. 3, each of yarns 10 is comprised of conductive filaments 11 and non-conductive filaments 12. In block D of fabric 8, the ratio of conductive filaments 11 to non-conductive filaments 12 in each yarn 10 is ten to two respectively. Progressing from block D to blocks D' and D", the ratio of conductive filaments to non-conductive filaments decreases. Thus, each of yarns 10' have six conductive filaments for each six non-conductive filaments, and each of yarns 10" have two conductive filaments for each ten non-conductive filaments. If desirable, the progression of gradually increasing the ratio of non-conductive to conductive filaments may be continued until a band of yarns made entirely from non-conductive filaments is provided in the fabric. A modification of the foregoing example is to begin with a yarn comprised predominantly of high conductivity filaments. To provide yarns of decreasing conductivity, the number of high conductivity filaments is decreased without substituting them with non-conductive filaments. Thus, not only is the conductivity of the yarn decreased, but the diameter and denier is as well. A fabric constructed with yarns varied in such a way would show a gradient for both conductivity and thickness.

Referring to FIG. 4, woven fabric 13 has warp yarns 14 and blocks E, E' and E" of weft yarns 15, 15' and 15" respectively. In a preferred embodiment, the weft yarns are comprised of synthetic filaments such as nylon 6,6, which have been coated with polypyrole according to the techniques disclosed in Kuhn et al., U.S. Pat. No. 4,803,096. The amount of polypyrole deposited on a nylon yarn determines its conductivity and is dependant, among other factors, upon the concentration of reactants in the aqueous, reaction solution. The conductivity of a polypyrole coated substrate can be controlled to manufacture yarns 15 of high conductivity, yarns 15' of intermediate conductivity and yarns 15" of relatively low conductivity. Thus, the aforementioned yarns can be grouped in blocks E, E' and E", respectively, to create a gradient of conductivity.

Figure 5:
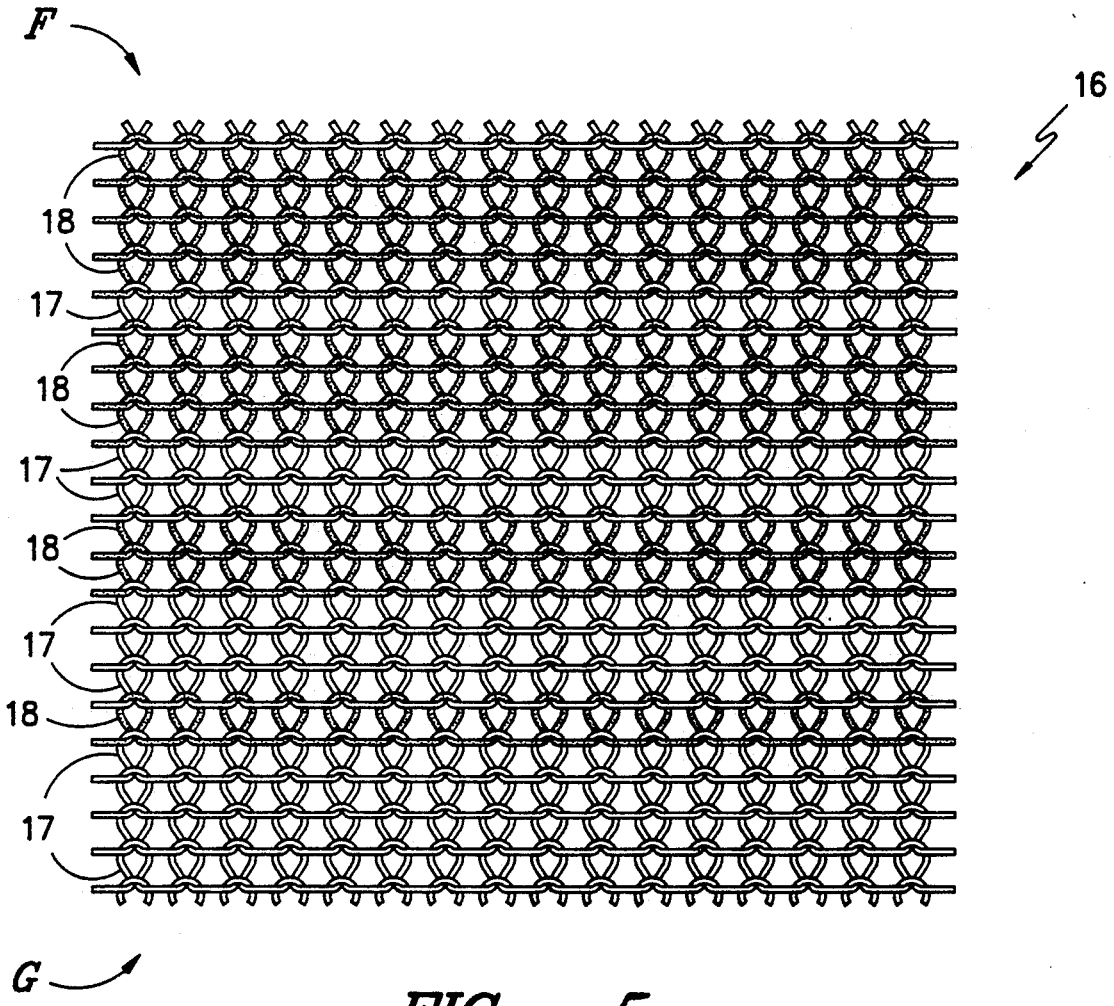
FIG. 5 is a knitted fabric having a gradient created by a pattern of courses which gradually increases the concentration of high conductivity yarns.

FIG. 5 represents the foregoing principle of selective incorporation of high and low conductivity yarns to produce a gradient applied to a knitted fabric. Fabric 16 is a jersey knit having a conductivity gradient from top F to bottom G formed by gradually increasing the number of courses of low conductivity yarns 17 relative to the number of courses of high conductivity yarns 18. As with a woven fabric, the high and low conductivity yarns may be distinguished by their inherent conductivity e.g. copper versus cotton, the relative number of non-conductive and conductive filaments or spun fibers per yarn or the degree of conductivity imparted by a topical treatment of a yarn e.g. the amount of conductive polymer deposited on the surface of a yarn.

Figure 6:
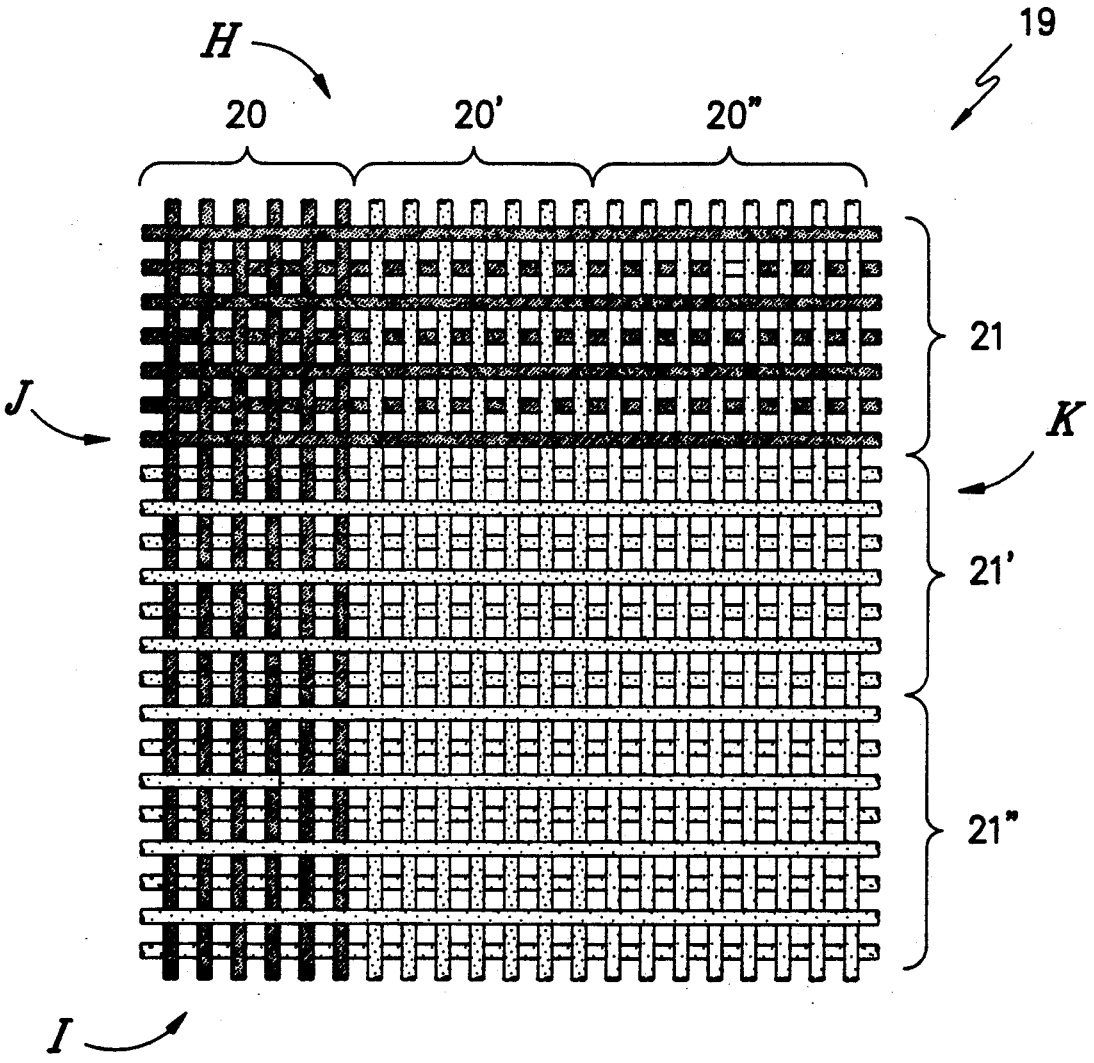
FIG. 6 is a non-woven fabric having a gradient in two directions.

Referring to FIG. 6, non-woven fabric 19 having warp yarns 20, 20' and 20" which are alternately overlaid and underlaid by weft yarns 21,21' and 21". The warp and weft yarns are held together with an adhesive, such as polyvinyl acetate, as is well known in the art. Alternatively, the yarns may be held together by any of a variety of known techniques such as applying a backing of plastic film or adhesion to a needle punched batt. As in the example shown in FIG. 4, the weft yarns 21, 21' and 21" vary in conductivity from high to low based upon the thickness of conductive polymer coating deposited thereon. Additionally, fabric 19 illustrates that the conductivity of the warp yarns may be varied to create a gradient from Side J to opposite side K and used in combination with weft yarns which vary in conductivity from top H to bottom I resulting in the least conductive area being the lower, right-hand corner of fabric 19 and the area of greatest conductivity being the upper left-hand corner of fabric 19. Thus, warp yarns 20, 20' and 20'' may also vary in conductivity based upon their having been rendered more or less conductive by deposition of a conductive polymer thereon.

In an alternative embodiment of the invention, individual staple fibers of various levels of conductivity may be arranged in a non-woven batt to create a similar gradient pattern as shown above.

The invention may be further understood by reference to the following examples but the invention is not to be construed as being unduly limited thereby. Unless otherwise indicated, all parts and percentages are by weight.

Standard test methods are available in the textile industry and, in particular, AATCC test method 76-1987 is available and has been used for the purpose of measuring the resistivity of textile fabrics or yarns. According to this method, two parallel electrodes 2 inches long are contacted with the fabric or yarn and placed 1 inch apart. Resistivity may then be measured with a standard ohm meter capable of measuring values between 1 and 20 million ohms. Measurements are reported in ohms per inch. Alternatively, fabrics are measured in both directions and the resistance is added in order to obtain surface or sheet resistivity in ohms on a per square basis. While conditioning of the samples may ordinarily be required to specific relative humidity levels, it has been found that conditioning of the samples made according to the present invention is not necessary since conductivity measurements do not vary significantly at different humidity levels. Resistivity measurements reported in ohms per square (Ω/sq) may be converted to the corresponding conductivity by dividing resistivity by one.

EXAMPLE 1

A fabric was woven on a Nissan water jet weaving machine using a 70 denier, 23 filament nylon warp with 94 ends per inch and 54 inches wide. Two filling yarns were used: a regular untreated 2-ply 150 denier textured polyester yarn which has a liner resistance of over 1,000,000 ohms per inch and a polypyrrole treated 3-ply, 150 denier textured yarn with a liner resistance of about 9,100 ohms per inch. The weave construction was 1×1, plain and the pick oount was 50 PPI. The filling yarns were inserted in bands of 16 picks, each pick being either the regular or the treated yarn. The following liner progression pattern layout was used:

| Picks of Untreated | Picks of Treated | |
|---|---|---|
| 0 | 0 | 0% untreated, 100% treated |
| 1 | 15 | 6.25% untreated |
| 1 | 5 | 18.75% untreated |
| 1 | 4 2 times | |
| 1 | 3 4 times | 25.00% untreated |
| 1 | 2 | 31.25% untreated |
| 1 | 3 | |
| 1 | 2 3 times | |
| 1 | 2 3 times | 37.5% untreated |
| 1 | 1 | |
| 1 | 2 | |
| 1 | 1 | |
| 1 | 2 | 43.75% untreated |
| 1 | 1 2 times | |
| 1 | 2 | |

-continued

| Picks of Untreated | Picks of Treated | |
|---|---|---|
| 1 | 1 3 times | |
| 1 | 1 4 times | 50% untreated |

. . . continue as a mirror image of above to gradually produce 100% untreated, 0% treated.

This produced a gradient fabric of approximately 3½ inches, connecting an area of fabric containing 100% treated filling yarn to an area containing 100% untreated yarn.

The electrical resistance of this fabric in the fillingwise direction was tested using a DC ohm meter with electrodes 2 inches wide and 1 inch apart. The fabric was tested with the electrode completely in the area containing 100% treated yarn and at multiple points across the fabric, spaced apart as shown in the following table:

TABLE 1

| Center of Electrode | Ohms/2" width |
|---|---|
| In 100% treated fabric | 91 |
| ½ inch in treated | 109 |
| Edge of gradient | 115 |
| ½ inch inside gradient | 132 |
| 1 inch inside gradient | 150 |
| 1½ inch inside gradient | 169 |
| 2 inch inside gradient | 247 |
| 2½ inch inside gradient | 335 |
| 3 inch inside gradient | 568 |
| 3½ inch inside gradient (edge of gradient) | 1,163 |
| ½ inch in untreated | 4,870 |
| In 100% untreated fabric | over 1,000,000 |

The fabric was tested in the warpwise direction with the same ohm meter and found to have resistance of over 1 million ohms. The difference in resistance in the fillingwise vs warpwise direction results in a unique polarization.

EXAMPLE 2

A series of six, 2-ply 150 denier textured polyester yarns treated with different amounts of polypyrrole prepared according Kuhn et al., U.S. Pat. No. 4,803,096, and a similar size untreated polyester yarn were knit into eleven narrow bands about ⅓ inch wide (10 knit courses each) using a circular knitting machine with 14.5 needles per inch and a jersey stitch construction. The six yarns which were treated with a conductive polymer to varying levels of conductivity, and the untreated yarn were paired in various combinations to achieve eleven different bands having a gradual change in conductivity from high to low. The pairs of yarn were fed into the knitting machine in lengths sufficient to knit ten courses. The treated yarns used had resistances in ohms per inch of from 4,230 to 130,000. The untreated yarn has a resistance of over 1,000,000 ohms per inch.

The resulting circular knit fabric was slit walewise to form a flat fabric which was tested for its microwave insertion loss.

The data shown in FIG. 7 as a graph of dB of attenuation v. band number (⅓ inch each), was obtained by placing the fabric in a wave guide connecting a microwave transmitter operating at 8 Ghz. to a suitable power sensor serving as a receiver. The decrease in the measured voltage level at the receiver, when the fabric is placed within the wave guide, is a measure of the microwave attenuation due to the fabric. The attenuation, or insertion loss, is usually expressed in decibels. This value is calculated in the following manner. The insertion loss, $dB_i = 20 \log (E_r/E_t)$ where $E_t$ is the voltage measured at the receiver in the absence of the test sample and $E_r$ is the voltage measured at the receiver, when a sample is inserted into the waveguide.

The equipment used in the above measurements is manufactured by Loral Microwave-Narda of Hauppauge, N.Y. and consist of a microwave measurement system display unit Model 7000A and a microwave unit Model 7105.

Using previously developed comparison data, this attenuation data was converted into predicted resistance data or microwave impedance values, and this data is shown as a graph in FIG. 8.

There are, of course, many alternate embodiments and modifications which are intended to be included within the scope of the following claims.

What I claim is:

1. An electrically conductive textile fabric having a conductivity gradient therein, characterized by a first area of relatively high conductivity and a second area of relatively low conductivity, comprising:

a plurality of high conductivity yarns incorporated into the body of said fabric having a conductivity greater than an average conductivity across said gradient;

a plurality of low conductivity yarns incorporated into the body of said fabric having a conductivity less than an average conductivity across said gradient and less than said conductivity of said high conductivity yarns;

wherein a concentration of said high conductivity yarns relative to said low conductivity yarns in said first area is sufficient to achieve a conductivity greater than said average conductivity across said gradient; and wherein a concentration of said high conductivity yarns relative to said low conductivity yarns in said second area is sufficient to achieve a conductivity less than said average conductivity across said gradient.

2. A fabric according to claim 1 wherein said fabric is a woven or knitted fabric.

3. A fabric according to claim 2 wherein said high conductivity yarns and said low conductivity yarns are distinguishable by characteristics selected from the inherent conductivity of said yarns, denier of said yarns, relative number of conductive to non-conductive filaments or spun fibers comprising said yarns and conductivity imparted by surface treatment or coating on said yarns.

4. A fabric according to claim 3 wherein said fabric is woven.

5. A fabric according to claim 4 wherein a number of said high conductivity yarns per inch is greater in said first area than a number of said low conductivity yarns and a number of said low conductivity yarns per inch is greater in said second area than a number of said high conductivity yarns.

6. A fabric according to claim 5 further comprising a transition area between said first and second areas wherein the relative number of said high and low conductivity yarns per inch are at an intermediate concentration between said concentrations in said first and second areas.

7. A fabric according to claim 3 wherein said fabric is knitted.

8. A fabric according to claim 7 wherein a number of said high conductivity yarns per inch is greater in said first area than a number of said low conductivity yarns and a number of said low conductivity yarns per inch is greater in said second area than a number of said high conductivity yarns.

9. A fabric according to claim 8 further comprising a transition area between said first and second areas wherein the relative number of said high and low conductivity yarns per inch are at an intermediate concentration between said concentrations in said first and second areas.

10. A fabric according to claim 3 wherein said high conductivity yarns comprise filaments or spun fibers selected from metal, metal containing compounds, carbon and conductive polymer coated yarns.

11. A fabric according to claim 3 wherein said high conductivity yarn comprises conductive polymer coated filaments and spun fibers and said conductive polymer is selected from polypyrole and polyaniline.

12. A fabric according to claim 3 wherein said fabric is a non-woven.

* * * * *